US009237818B2

(12) United States Patent
Antoniou

(10) Patent No.: US 9,237,818 B2
(45) Date of Patent: Jan. 19, 2016

(54) MOUNTING ASSEMBLY FOR A MEDAL AND A RIBBON AND A METHOD OF MOUNTING THE MEDAL AND THE RIBBON

(71) Applicant: Matthew J. Antoniou, Lake Orion, MI (US)

(72) Inventor: Matthew J. Antoniou, Lake Orion, MI (US)

( * ) Notice: Subject to any disclaimer, the term of this patent is extended or adjusted under 35 U.S.C. 154(b) by 238 days.

(21) Appl. No.: 14/133,713

(22) Filed: Dec. 19, 2013

(65) Prior Publication Data

US 2015/0173534 A1 Jun. 25, 2015

(51) Int. Cl.
*A47G 1/12* (2006.01)
*A44C 3/00* (2006.01)

(52) U.S. Cl.
CPC . *A47G 1/12* (2013.01); *A44C 3/004* (2013.01); *A47G 2200/106* (2013.01); *Y10T 29/49826* (2015.01)

(58) Field of Classification Search
CPC ..... A47G 1/12; A44C 3/004
See application file for complete search history.

(56) References Cited

U.S. PATENT DOCUMENTS

| | | | | |
|---|---|---|---|---|
| 6,817,129 | B1 * | 11/2004 | Purdy | A47G 1/12 407/722 |
| 7,789,249 | B1 * | 9/2010 | Merbeth | A47B 97/00 211/87.01 |
| 2009/0317652 | A1 * | 12/2009 | Keyes | A44C 3/004 428/542.4 |
| 2013/0326920 | A1 * | 12/2013 | Hopper | A44C 3/002 40/1.5 |
| 2014/0245586 | A1 * | 9/2014 | Rojas | A47G 1/12 29/428 |

* cited by examiner

*Primary Examiner* — Gary Hoge
(74) *Attorney, Agent, or Firm* — Buckert Patent & Trademark Law Firm, PC; John F. Buckert

(57) ABSTRACT

A mounting assembly for a medal is provided. The medal is coupled to a ribbon. The mounting assembly includes a housing, a magnet disposed in the housing, and a clip member having first and second walls. The first wall has a first surface and a second surface. The second wall has a biasing portion extending toward the first wall. The second wall is coupled to the housing such that a gap is formed between the biasing portion and the first surface of the first wall. The mounting assembly further includes an adhesive sheet that is disposed on the second surface of the first wall. The adhesive sheet is configured to hold the medal thereon.

16 Claims, 20 Drawing Sheets

MOUNTING ASSEMBLY FOR A MEDAL AND A RIBBON AND A METHOD OF MOUNTING THE MEDAL AND THE RIBBON

BACKGROUND

Many clubs, sports teams, and sporting events offer a reward for the completion of a goal in the form of a medal attached to a ribbon designed to be worn around the participant's neck. Currently, most participants wear their medal for a brief period and then place the medal in storage. Thus, participants do not have an easy or convenient way of displaying their medal other than by wearing the medal around their neck.

Accordingly, the inventor herein has recognized a need for a mounting assembly for displaying a medal and a ribbon that minimizes and/or eliminates the above-mentioned deficiency.

SUMMARY

A mounting assembly for a medal in accordance with an exemplary embodiment is provided. The medal is coupled to a ribbon. The mounting assembly includes a housing and a magnet that is disposed in the housing. The mounting assembly further includes a clip member having first and second walls. The first wall has a first surface and a second surface disposed opposite to the first surface. The second wall has a biasing portion extending toward the first wall. The second wall is coupled to the housing such that a gap is formed between the biasing portion and the first surface of the first wall. The mounting assembly further includes an adhesive sheet that is disposed on the second surface of the first wall. The adhesive sheet is configured to hold the medal thereon.

A method of mounting a medal on a mounting assembly in accordance with another exemplary embodiment is provided. The method includes providing the medal with a ribbon attached to the medal. The method further includes providing the mounting assembly having a housing, a magnet, a clip member, and an adhesive sheet. The housing has the magnet disposed therein. The clip member has first and second walls. The first wall has a first surface and a second surface disposed opposite to the first surface. The second wall has a biasing portion extending toward the first surface of the first wall. The second wall is coupled to the housing such that a gap is formed between the biasing portion and the first surface of the first wall. The adhesive sheet is disposed on the second surface of the first wall. The method further includes disposing a portion of the ribbon in the gap such that the biasing portion urges the ribbon against the first surface of the first wall to hold the portion of the ribbon within the first gap. The method further includes attaching the medal to the adhesive sheet.

A method of mounting a medal on a mounting assembly in accordance with another exemplary embodiment is provided. The method includes providing the medal with a ribbon attached to the medal. The method further includes disposing a sheath member around a portion of the ribbon. The method further includes providing the mounting assembly having a housing, a magnet, a clip member, and an adhesive sheet. The housing has the magnet disposed therein. The clip member has first and second walls. The first wall has a first surface and a second surface disposed opposite to the first surface. The second wall has a biasing portion extending toward the first surface of the first wall. The second wall is coupled to the housing such that a gap is formed between the biasing portion and the first surface of the first wall. The adhesive sheet is disposed on the second surface of the first wall. The method further includes disposing the sheath member in the gap such that the biasing portion urges the sheath member against the first surface of the first wall to hold the sheath member and the portion of the ribbon within the gap. The method further includes attaching the medal to the adhesive sheet.

DETAILED DESCRIPTION

Figure 1:
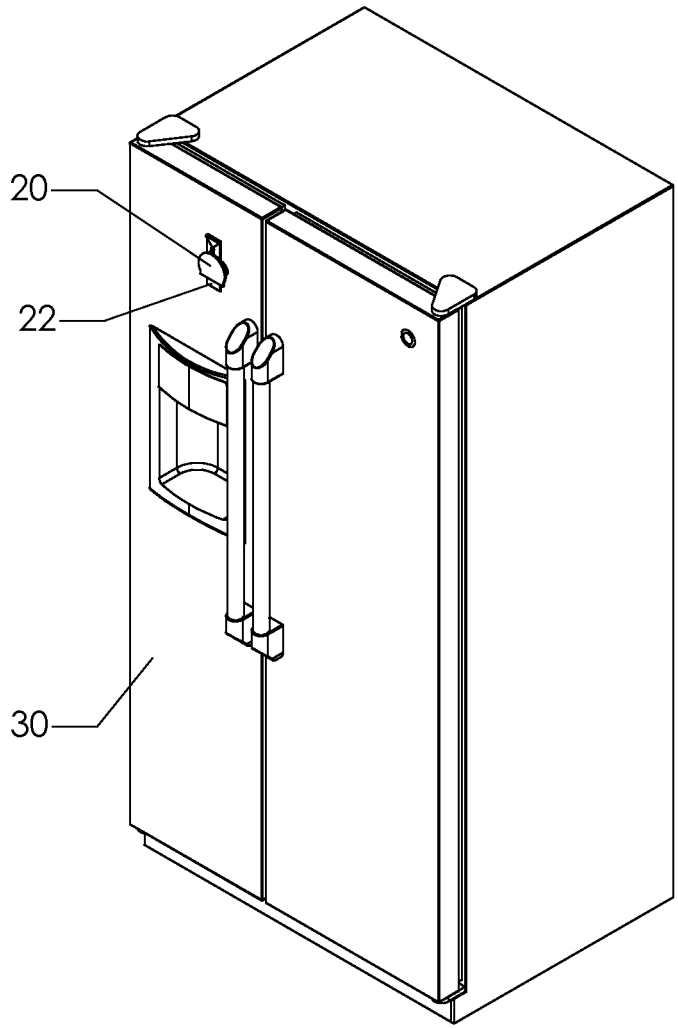
FIG. 1 is a schematic of a medal and a ribbon being held on a refrigerator by a mounting assembly in accordance with an exemplary embodiment.
Figure 2:
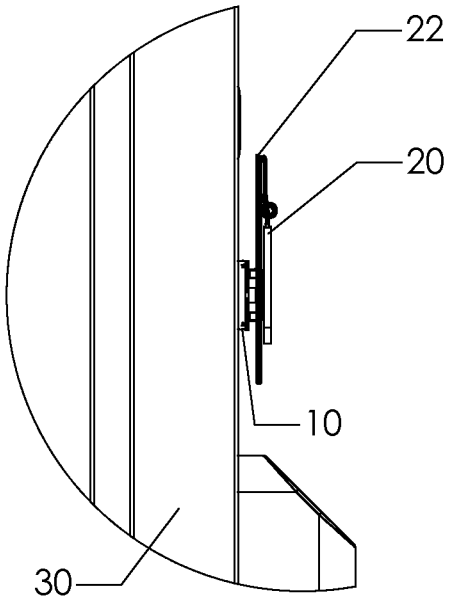
FIG. 2 is an enlarged side view of the medal and the ribbon, the mounting assembly, and a portion of the refrigerator of FIG. 1.
Figure 3:
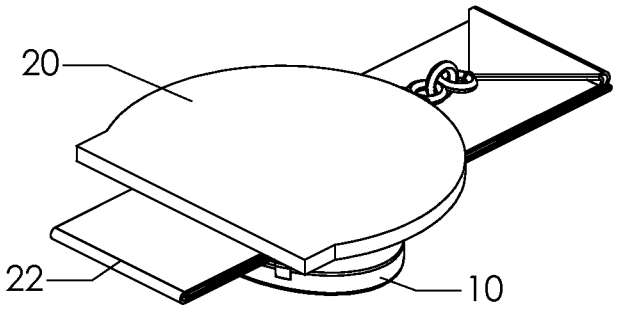
FIG. 3 is a schematic of the medal and the ribbon coupled to the mounting assembly of FIG. 2.
Figure 4:
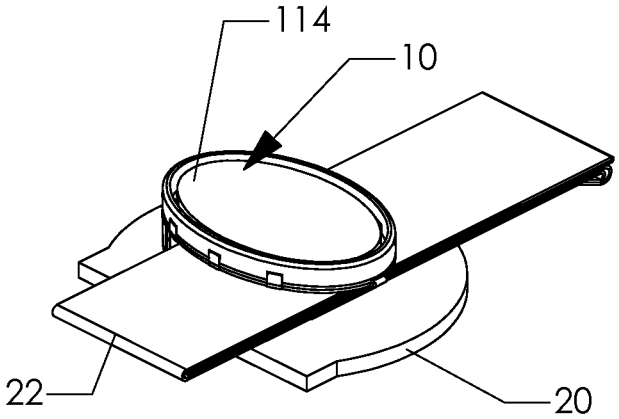
FIG. 4 is another schematic of the medal and the ribbon coupled to the mounting assembly of FIG. 2.
Figure 5:
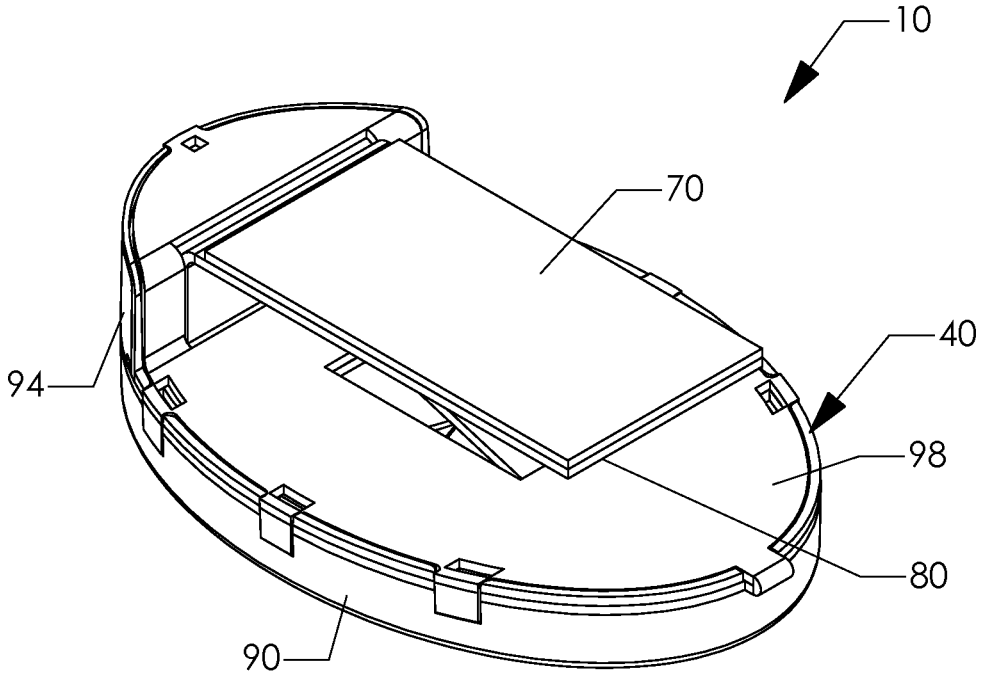
FIG. 5 is an enlarged schematic of the mounting assembly of FIG. 2.

Referring to FIGS. 1-4, a medal 20 and a ribbon 22 that are mounted to a refrigerator 30 by a mounting assembly 10 in accordance with an exemplary embodiment is illustrated. The refrigerator 30 is constructed of a metal. An advantage of the mounting assembly 10 is that the assembly 10 allows a user to easily mount the medal 20 and the ribbon 22 on a metal surface.

Referring to FIGS. 5-8 and 16, the mounting assembly 10 is provided to removably hold the medal 20 and the ribbon 22 thereon, and to be removably mounted onto a metal surface. The mounting assembly includes a housing 40, magnets 50, 52, a clip member 60, an adhesive sheet 70, and optionally a sheath member 80.

Referring to FIGS. 8-12, the housing 40 is provided to hold the magnets 50, 52 therein and to hold the clip member 60 thereon. The housing 40 includes a base member 90, an extension member 94, and a cover member 98. In an exemplary embodiment, the base member 90, the extension member 94 and the cover member 98 are constructed of plastic. Of course, in an alternative embodiment, the base member 90, the extension member 94, and the cover member 98 could be constructed of other materials such as wood or ceramic for example.

Figure 8:
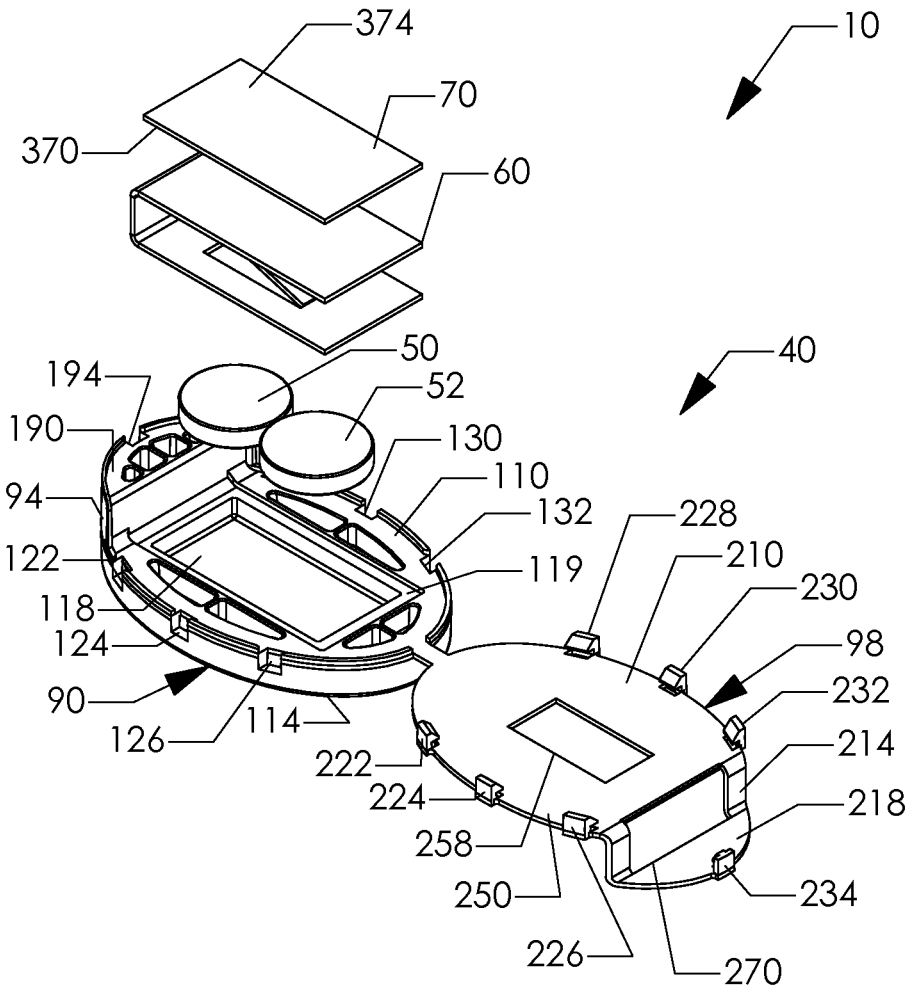
FIG. 8 is an exploded view of the mounting assembly of FIG. 5.
Figure 9:
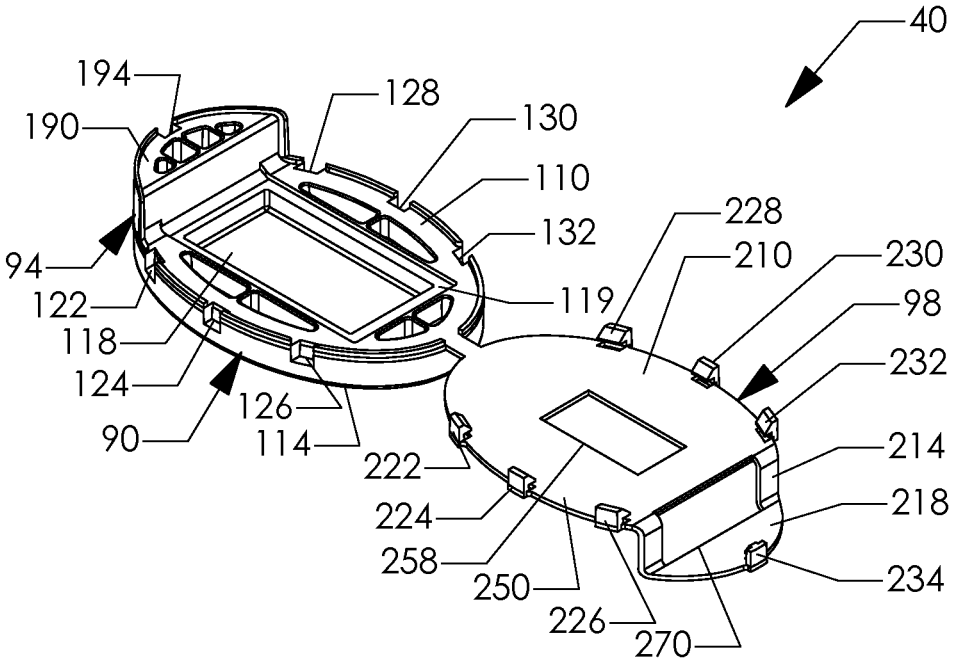
FIG. 9 is a schematic of a housing utilized in the mounting assembly of FIG. 5.
Figure 10:
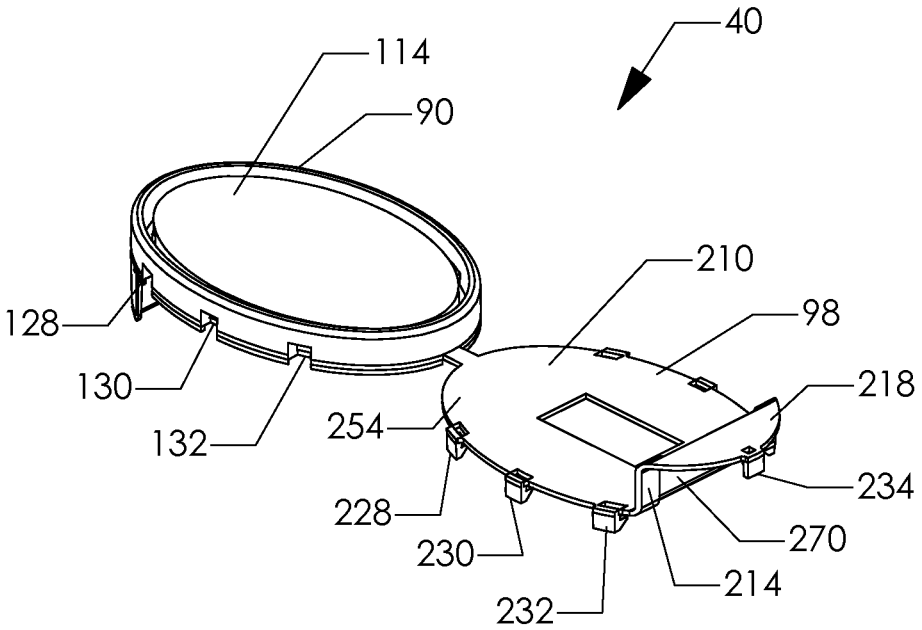
FIG. 10 is another schematic of the housing of FIG. 9.
Figure 11:
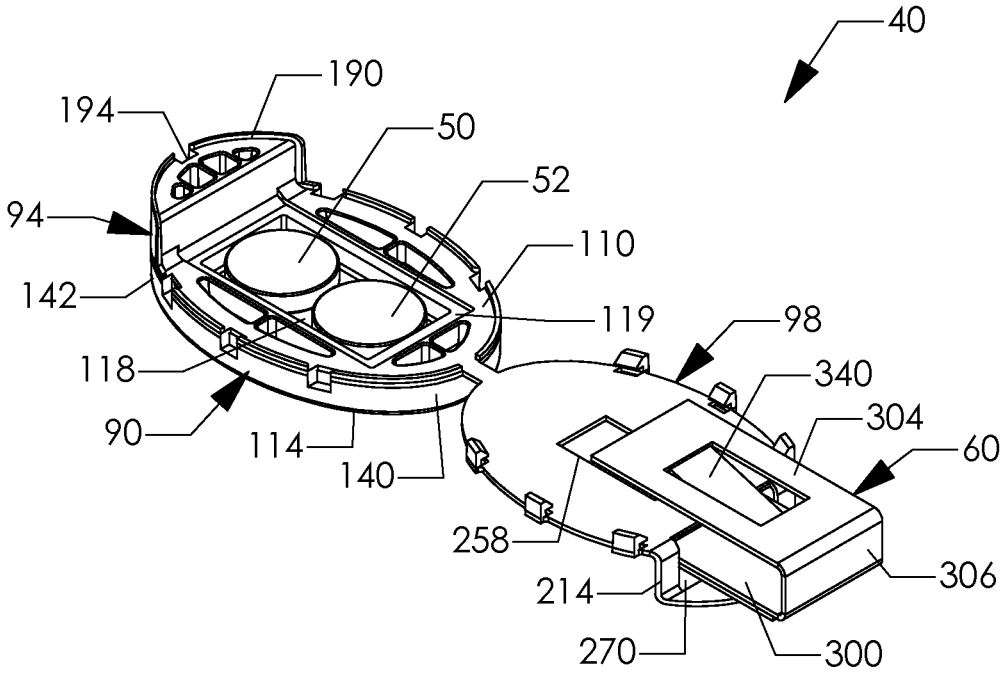
FIG. 11 is a partially assembled view of the mounting assembly of FIG. 5.
Figure 12:
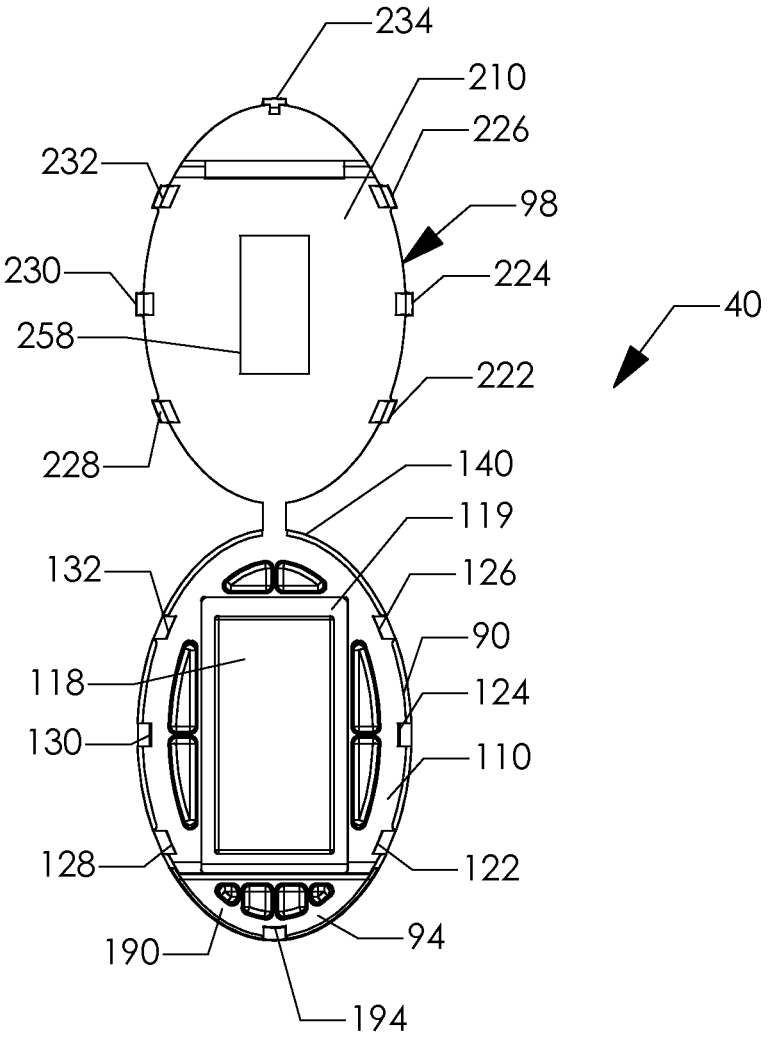
FIG. 12 is a top view of the housing utilized in the mounting assembly of FIG. 5.
Figure 13:
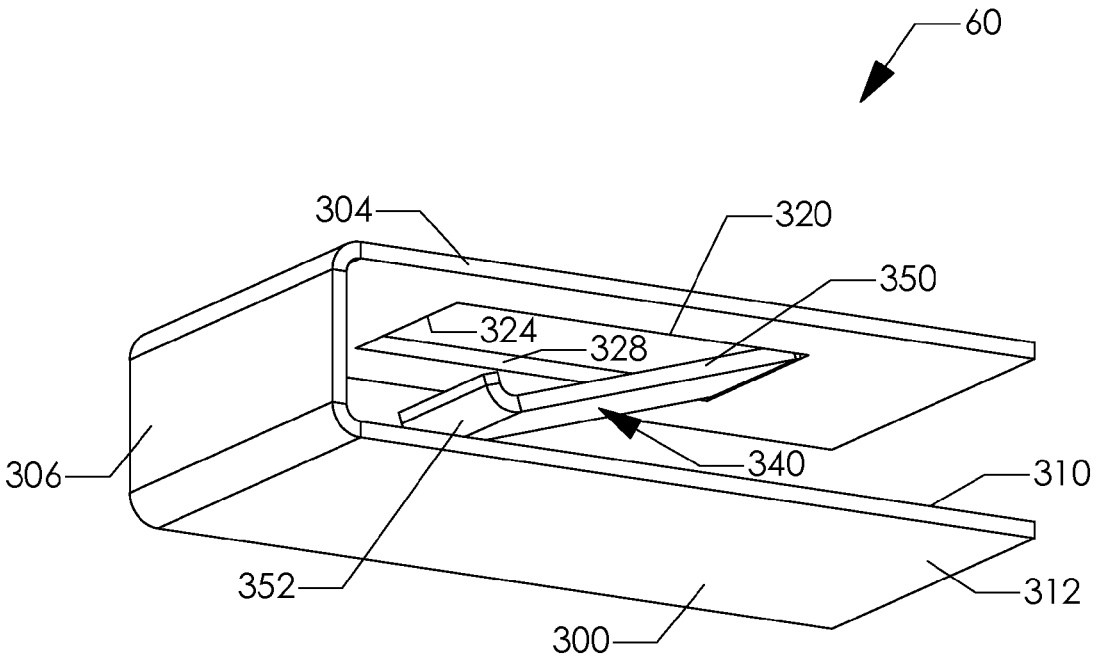
FIG. 13 is a schematic of a clip member utilized in the mounting assembly of FIG. 5.
Figure 14:
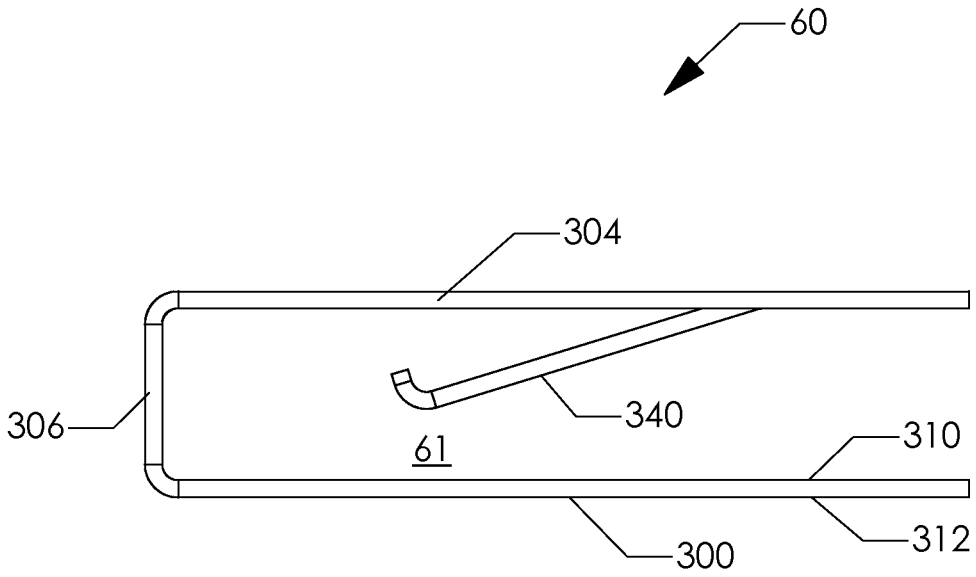
FIG. 14 is a side view of the clip member of FIG. 13.
Figure 15:
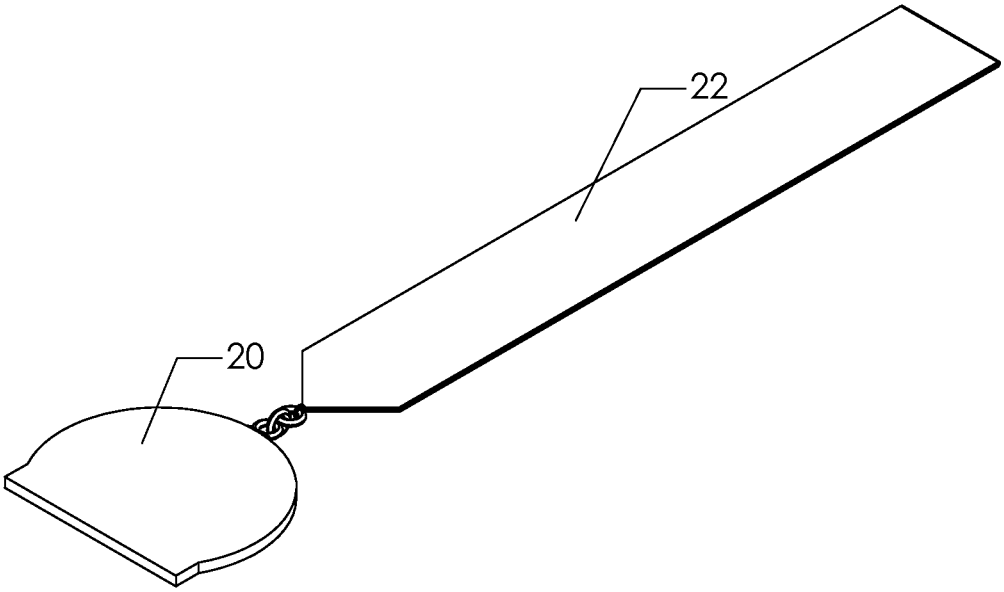
FIG. 15 is a schematic of a medal coupled to a ribbon.
Figure 16:
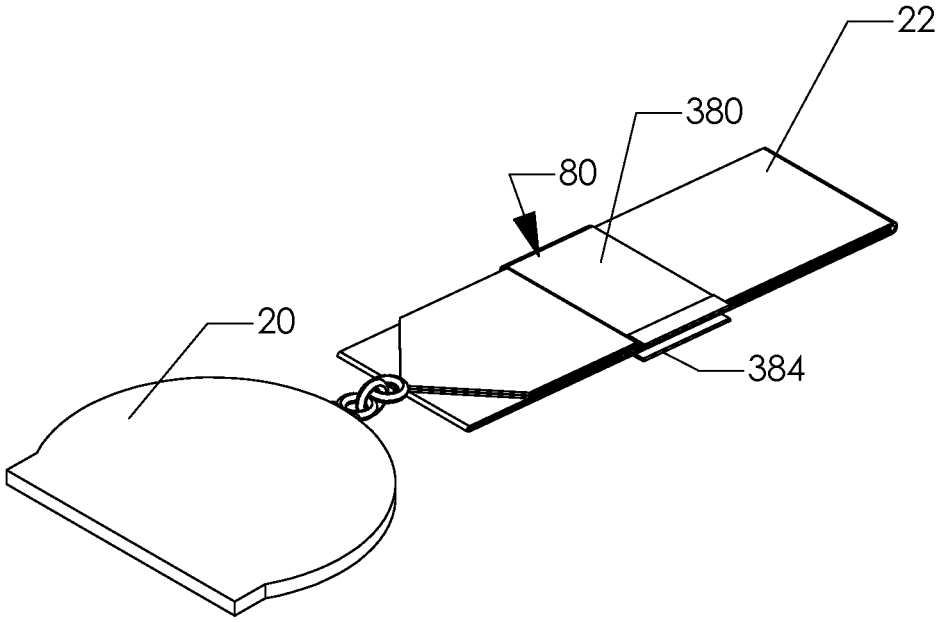
FIG. 16 is a schematic of the medal and the ribbon of FIG. 15 in which the ribbon is folded and a sheath member is disposed over a portion of the folded ribbon.
Figure 17:
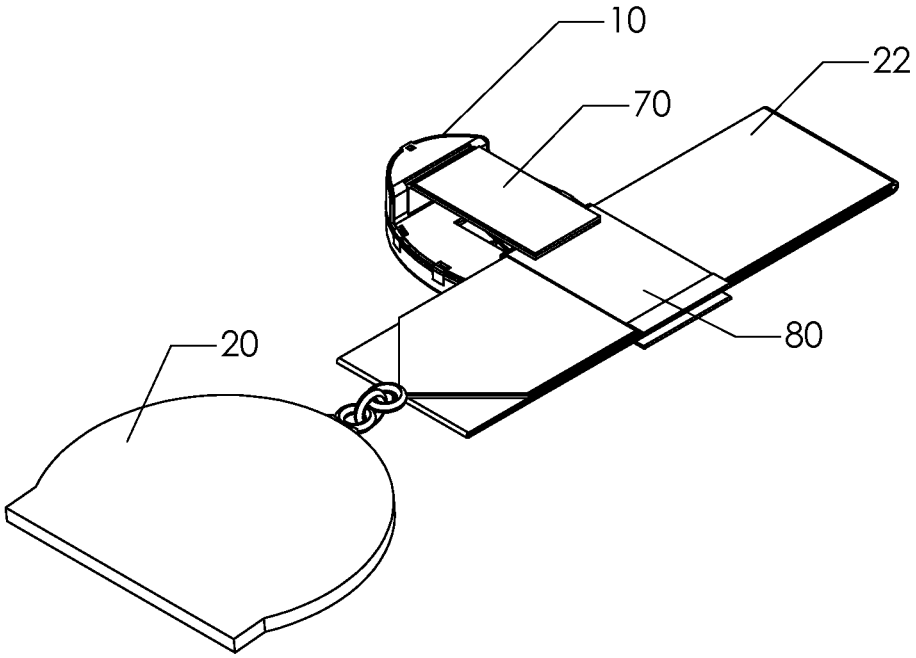
FIG. 17 is a schematic of the medal, the ribbon, and the sheath member of FIG. 16 in which the sheath member is being disposed within a gap of the mounting assembly.
Figure 18:
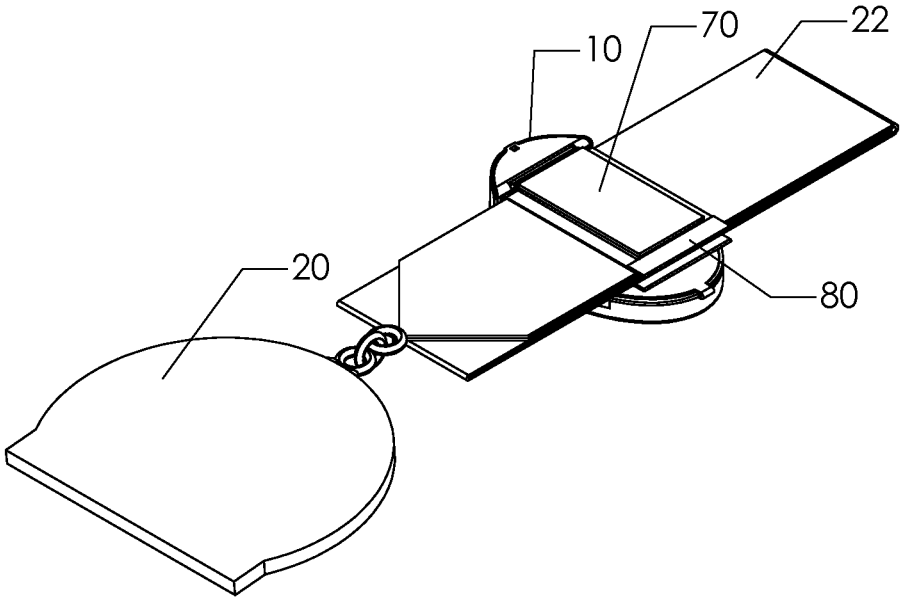
FIG. 18 is a schematic of the medal, the ribbon, the sheath member of FIG. 17 in which the sheath member and the ribbon are removably coupled to a housing of the mounting assembly utilizing the clip member of FIG. 13.
Figure 19:
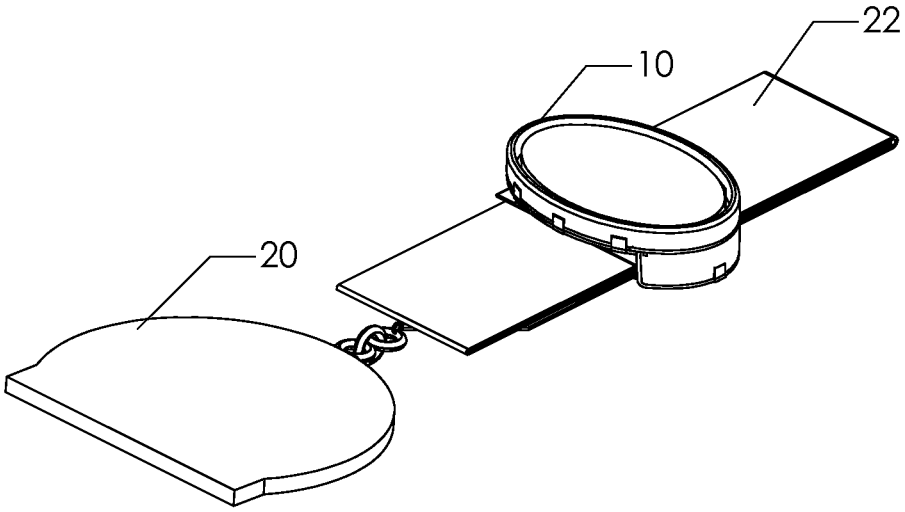
FIG. 19 is another schematic of the medal, the ribbon, the sheath member of FIG. 17 in which the sheath member and the ribbon is removably coupled to the housing of the mounting assembly.

Referring to FIGS. 8, 11 and 12, the base member 90 has a first side 110, a second side 114, and a cavity 118 extending into the first side 110. The cavity 118 is sized and configured to receive the magnets 50, 52 therein. The base member 90 further includes a groove 119 extending around the cavity 118 and communicating with the cavity 118. An outer periphery of a second wall 304 (shown in FIG. 11) of the clip member 60 is disposed in the groove 119 such that the second wall 304 encloses the cavity 118 and the magnets 50, 52 are disposed within the cavity 118 between the second wall 304 and the base member 90. The base member 90 further includes grooves 122, 124, 126, 128, 130, 132 extending from the first side 110 into the base member 90. The grooves 122, 124, 126, 128, 130, 132, are configured to receive the coupling tabs 222, 224, 226, 228, 230, 232, 234, respectively, of the cover member 98 therein for coupling the cover member 98 to the base member 90. The base member 90 further includes end portions 140, 142 (shown in FIG. 11).

Figure 6:
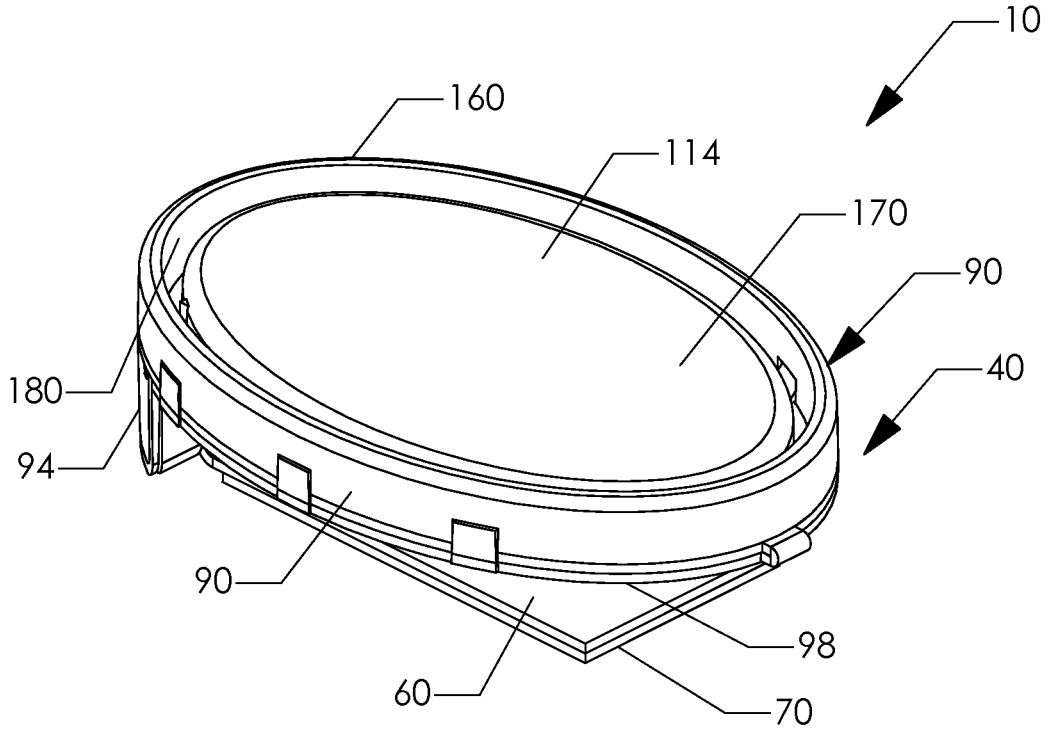
FIG. 6 is another enlarged schematic of the mounting assembly of FIG. 5.
Figure 7:
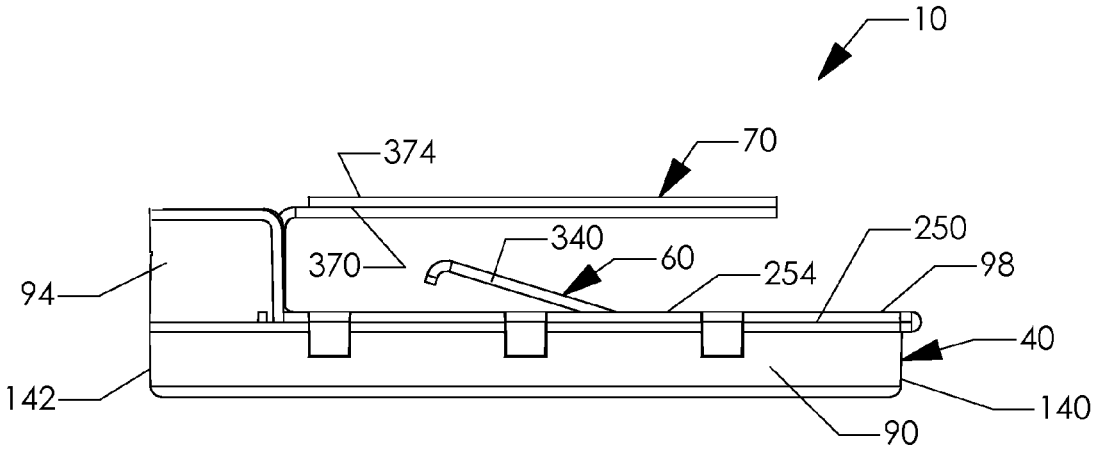
FIG. 7 is a side view of the mounting assembly of FIG. 5.

Referring to FIG. 6, the second side 114 of the base member 90 has a peripheral surface region 160 and an inner surface region 170 disposed within the peripheral surface region 90. A groove 180 is disposed between the peripheral surface region 160 and the inner surface region 170. The inner surface region 170 is disposed a predetermined distance in an axial direction from the peripheral surface region 160, such that when the peripheral surface region 160 contacts a flat surface (e.g., a flat surface of a refrigerator), the inner surface region 170 does not contact the flat surface. In an exemplary embodiment, the second side 114 is substantially oval-shaped. Of course, in an alternative embodiment, the second side 114 could have another shape such as a circular shape or a rectangular shape for example.

Referring to FIGS. 11 and 12, the extension member 94 is coupled to the end portion 142 of the base member 90 and extends outwardly from the first side 110 of the base member 90 substantially perpendicular to the first side 110. The extension member 94 includes a top surface 190 and a groove 194 extending from the top surface into the extension member 94. The groove 194 is configured to receive a coupling member 234 of the cover member 98 therein for coupling a portion of the cover member 98 to the base member 90.

Referring to FIGS. 8 and 10-12, the cover member 98 is configured to maintain the magnets 50, 52 within the cavity 118 and to hold a portion of the clip member 60 therein. The cover member 98 includes a cover plate 210, an abutment plate 214, a cap plate 218, and coupling tabs 222, 224, 226, 228, 230, 232, 234.

The cover plate 210 has a first side 250 and a second side 254 disposed opposite to the first side 250. The cover plate 210 further includes an aperture 258 extending therethrough. In an exemplary embodiment, the aperture 258 is rectangular shaped and is configured to receive a biasing portion 340 of the clip member 60 therethrough.

The coupling tabs 222, 224, 226, 228, 230, 232 are coupled to and extend from the surface 250 of the cover plate 210. The coupling tabs 222, 224, 226, 228, 230, 232 are configured to be received within the grooves 122, 124, 126, 128, 130, 132, respectively, of the base member 90 for coupling the cover member 98 to the base member 90.

The abutment plate 214 is attached to an end of the cover plate 210 and extends substantially perpendicular to the cover plate 210. The abutment plate 214 has an aperture 270 extending therethrough for receiving the first wall 300 of the clip member 60 therethrough.

The cap plate 218 is attached to an end of the abutment plate 214 and extends perpendicular to the abutment plate 214. The cap plate 218 is configured to be disposed on the top surface 190 of the extension member 94 of the housing 40. The cap plate 218 includes a coupling tab 234 configured to be received within the groove 194 of the extension member 94.

During assembly of the mounting assembly 10, the first side 250 of the cover plate 210 is disposed against the first side 110 of the base member 90 such that: (i) the second wall 304 of the clip member 60 substantially encloses the cavity 118 of the base member 90, (ii) the second wall 304 is disposed against and between both the cover plate 210 and the base member 90, (iii) the abutment plate 214 is disposed against a portion of the extension member 94; (iv) the cap plate 218 is disposed against the top surface 190 of the extension member 94; and (v) the coupling tabs 222, 224, 226, 228, 230, 232, 234 are received within the grooves 122, 124, 126, 128, 130, 132, 194, respectively.

Referring to FIGS. 11, 13, 14, and 18, the clip member 60 is provided to hold the ribbon 22, or the sheath member 80 and the ribbon 22, within a gap 61 (shown in FIG. 14) defined by the clip member 60. In an exemplary embodiment, the clip member 60 is a substantially U-shaped member having a first wall 300, a second wall 304, and a third wall 306. The first and second walls 300, 304 extend substantially parallel to one another. The third wall 306 is coupled to ends of the first and second walls 300, 304 and is disposed substantially perpendicular to the first and second walls 300, 304. The first wall 300 has a first surface 310 and a second surface 312 disposed opposite to the first surface 310.

The second wall 304 has a biasing portion 340 that extends toward the first wall 300. The biasing portion 340 is formed from a central portion of the second wall 340 utilizing cut edges 320, 324, 328 that extend through the second wall 304. The biasing portion 340 includes a wall portion 350 and an arcuate-shaped wall portion 352 extending from an end of the wall portion 350. The second wall 304 is coupled to the housing 40 such that the gap 61 is formed between the biasing portion 340 and the first surface 310 of the first wall 300.

During assembly, the first wall 300 of the clip member 60 is disposed through the aperture 270 in the abutment plate 214 such that the biasing portion 340 of the second wall 304 extends through the aperture 258 of the cover plate 210. Further, an outer periphery of the second wall 304 is disposed in the groove 119 such that the second wall 304 substantially encloses the cavity 118 of the base member 90 and the magnets 50, 52 are disposed within the cavity 118 between the second wall 304 and the base member 90. The second wall 304 is further disposed against and between both the cover plate 210 and the base member 90.

Referring to FIGS. 5, 7, 8, 14 and 15 an adhesive sheet 70 is disposed on the second surface 312 of the first wall 300. The adhesive sheet 70 is configured to be attached to the second surface 312 and to hold the medal 20 thereon. In an exemplary embodiment, the adhesive sheet 70 is double-sided sticky tape. Of course, in an alternative embodiment, the adhesive sheet 70 could comprise a Velcro sheet, an adhesive, or a glue. If a Velcro sheet is utilized, a sticky side of a first Velcro sheet is attached to the second surface 312, and a sticky side of a second Velcro sheet is attached to the medal 20, and the first and second Velcro sheets could be removably coupled together to attach the medal 20 to the mounting assembly 10.

Referring to FIGS. 14-19, the sheath member 80 is an optional component that may or may not be used with the mounting assembly 10. The sheath member 80 is provided to protect the ribbon 22 from being torn by the biasing member 340 when the sheath member 80 and a portion of the ribbon 22 is inserted within the gap 61. In an exemplary embodiment, the sheath member 80 is constructed of a thin metal sheet that is folded into a substantially U-shaped sheet having first and second sheet portions 380, 384. The ribbon 22 is inserted within a space formed between the first and second sheet portions 380, 384. The sheath member 80 is inserted into the gap 61 and contacts the biasing member 340. In alternative embodiments, the sheath member 80 could be constructed of other materials such as plastic or cardboard for example.

Figure 20:
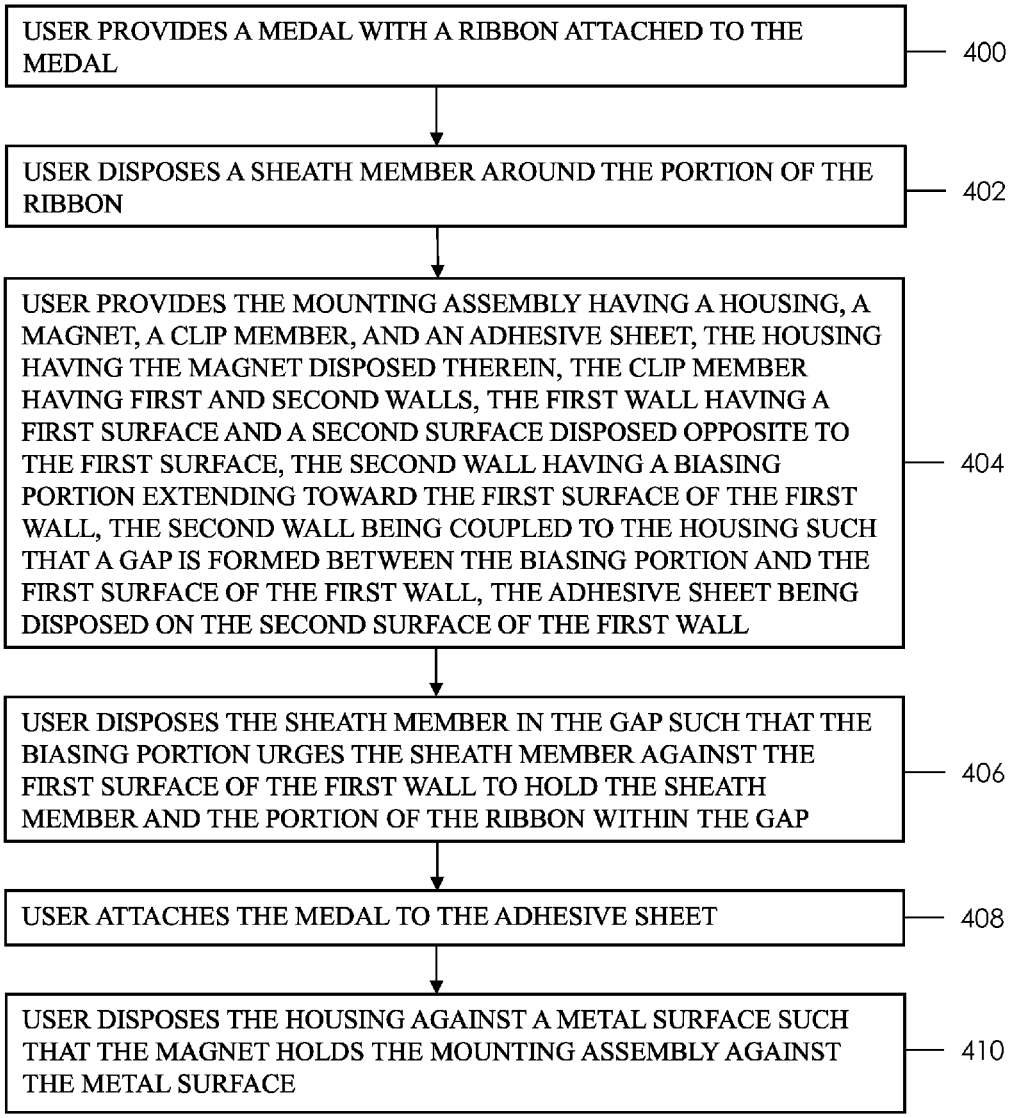
FIG. 20 is a method of mounting a medal on a mounting assembly in accordance with another exemplary embodiment.

Referring to FIGS. 1 and 20, a flowchart of a method for mounting the medal 20 on the mounting assembly 10 in accordance with another exemplary embodiment will now be described.

At step 400, the user provides the medal 20 with the ribbon 22 attached to the medal 20.

At step 402, the user disposes the sheath member 80 around the portion of the ribbon 22.

At step 404, the user provides the mounting assembly 10 having the housing 40, the magnet 50, the clip member 60, and the adhesive sheet 70. The housing 40 has the magnet 50 disposed therein. The clip member 60 has the first and second walls 300, 304. The first wall 300 has the first surface 310 and the second surface disposed opposite to the first surface 310. The second wall 304 has the biasing portion 340 extending toward the first surface 310 of the first wall 300. The second wall 304 is coupled to the housing 40 such that the gap 61 (shown in FIG. 14) is formed between the biasing portion 340 and the first surface 310 of the first wall 300. The adhesive sheet 70 is disposed on the second surface 312 of the first wall 300.

At step 406, the user disposes the sheath member 80 in the gap 61 such that the biasing portion 340 urges the sheath member 80 against the first surface 310 of the first wall 300 to hold the sheath member 80 and the portion of the ribbon 22 within the gap 61.

At step 408, the user attaches the medal 20 to the adhesive sheet 70.

At step 410, the user disposes the housing 40 against a metal surface (e.g., a surface of a refrigerator door) such that the magnet 50 holds the mounting assembly 10 against the metal surface.

Figure 21:
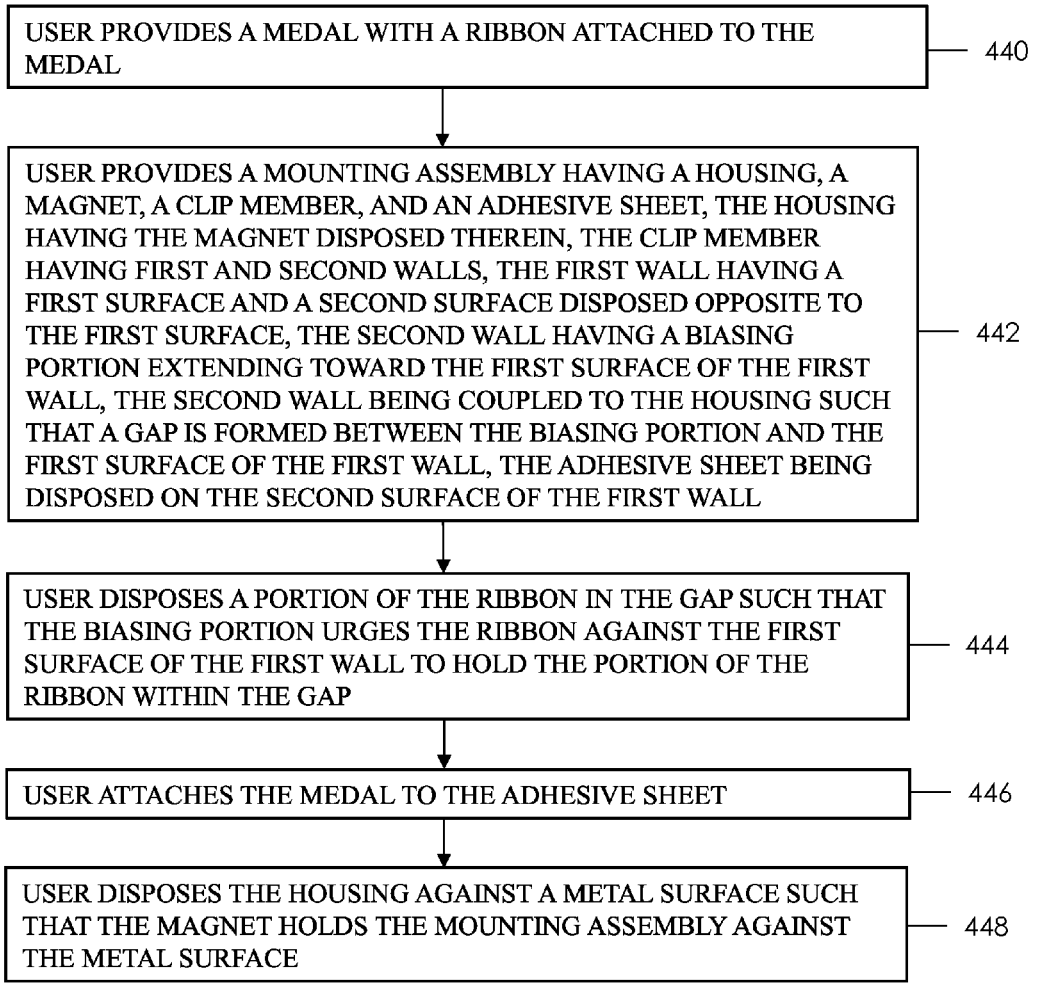
FIG. 21 is a method of mounting a medal on a mounting assembly in accordance with another exemplary embodiment.

Referring to FIGS. 1 and 21, a flowchart of a method for mounting the medal 20 on the mounting assembly 10 in accordance with another exemplary embodiment will now be described.

At step 440, a user provides the medal 20 with the ribbon 22 attached to the medal 20.

At step 442, the user provides a mounting assembly 10 having the housing 40, the magnet 50, the clip member 60, and the adhesive sheet 70. The housing 40 has the magnet 50 disposed therein. The clip member 60 has first and second walls 300, 304. The first wall 300 has the first surface 310 and the second surface 312 disposed opposite to the first surface 310. The second wall 304 has the biasing portion 340 extending toward the first surface 310 of the first wall 300. The second wall 304 is coupled to the housing 40 such that the gap 61 is formed between the biasing portion 340 and the first surface 310 of the first wall 300. The adhesive sheet 70 is disposed on the second surface of the first wall 300.

At step 444, the user disposes a portion of the ribbon 22 in the gap 61 such that the biasing portion 340 urges the ribbon 22 against the first surface 310 of the first wall 300 to hold the portion of the ribbon 22 within the gap 61.

At step 446, the user attaches the medal 20 to the adhesive sheet 70.

At step 448, the user disposes the housing 40 against a metal surface (e.g., a surface of a refrigerator door) such that the magnet 50 holds the mounting assembly 10 against the metal surface.

The mounting assembly 10 and the methods for mounting the medal 20 on the mounting assembly 10 provide a substantial advantage over other structures. In particular, the mounting assembly and methods provide a technical effect of utilizing a clip member having first and second walls, the first wall having a first surface and a second surface disposed opposite to the first surface, the second wall having a biasing portion extending toward the first wall, the second wall being coupled to the housing such that a gap is formed between the biasing portion and the first surface of the first wall; and an adhesive sheet being disposed on the second surface of the first wall, the adhesive sheet configured to hold the medal thereon.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A mounting assembly for a medal, the medal being coupled to a ribbon, comprising:

a housing;

a magnet being disposed in the housing;

a clip member having first and second walls, the first wall having a first surface and a second surface disposed opposite to the first surface, the second wall having a biasing portion extending toward the first wall, the second wall being coupled to the housing such that a gap is formed between the biasing portion and the first surface of the first wall; and an adhesive sheet being disposed on the second surface of the first wall, the adhesive sheet configured to hold the medal thereon.

2. The mounting assembly of claim 1, wherein the gap is sized and configured to receive a portion of the ribbon therein, such that the biasing portion urges the portion of the ribbon against the first surface of the first wall to hold the portion of the ribbon within the gap.

3. The mounting assembly of claim 1, wherein the mounting assembly further comprises a sheath member configured to be removably disposed over a portion of the ribbon.

4. The mounting assembly of claim 3, wherein the sheath member is disposed within the gap such that the biasing portion urges the sheath member against the first surface of the first wall to hold the sheath member and the portion of the ribbon within the gap.

5. The mounting assembly of claim 1, wherein:

the housing includes a base member, an extension member, and a cover member;

the base member having a first side and a second side with a cavity extending into the first side;

the extension member being coupled to an end portion of the base member and extending outwardly from the first side of the base member substantially perpendicular to the first side;

the cover member having a cover plate and an abutment plate, the cover plate having a first aperture extending therethrough, the abutment plate being attached to an end of the cover plate and extending substantially perpendicular to the cover plate, the abutment plate having a second aperture extending therethrough; and the magnet being disposed in the cavity.

6. The mounting assembly of claim 5, wherein the clip member is a substantially U-shaped clip member, the substantially U-shaped clip member having the first and second walls and a third wall, the first and second walls extending substantially parallel to one another, the third wall being coupled to ends of the first and second walls and being disposed substantially perpendicular to the first and second walls, the second wall having the biasing portion that extends toward the first wall.

7. The mounting assembly of claim 6, wherein:

the first wall of the substantially U-shaped clip member being disposed through the second aperture in the abutment plate such that the biasing portion of the second wall extends through the first aperture of the cover plate; and the cover plate being disposed against the first side of the base member such that the second wall of the substantially U-shaped clip member encloses the cavity of the base member, and the second wall is disposed against and between both the cover plate and the base member, and the abutment plate being disposed against a portion of the extension member.

8. The mounting assembly of claim 5, wherein the cover plate of the cover member has at least first and second coupling tabs, and the base member has at least first and second grooves extending from the first side into the base member, the first and second grooves configured to receive the first and second coupling tabs, respectively, therein for coupling the cover plate to the base member.

9. The mounting assembly of claim 5, wherein the base member further includes a groove extending around the cavity and communicating with the cavity, and an outer periphery of the second wall of the clip member being disposed in the groove such that the second wall encloses the cavity and the magnet is disposed within the cavity between the second wall and the base member.

10. The mounting assembly of claim 5, wherein the biasing portion is formed from a central portion of the second wall.

11. The mounting assembly of claim 5, wherein the cover member further includes a cap plate being attached to an end of the abutment plate and extending perpendicular to the abutment plate, the cap plate configured to be disposed on a surface of the extension member of the housing.

12. The mounting assembly of claim 5, wherein the second side of the base member has a peripheral surface region and an inner surface region disposed within the peripheral surface region, the inner surface region being disposed a predetermined distance in an axial direction from the peripheral surface region, such that when the peripheral surface region contacts a flat surface, the inner surface region does not contact the flat surface.

13. The mounting assembly of claim 5, wherein the second side of the base member is substantially oval-shaped.

14. The mounting assembly of claim 1, wherein the housing is a plastic housing, and the clip member is a steel clip member.

15. A method of mounting a medal on a mounting assembly, comprising:

providing the medal with a ribbon attached to the medal;

providing the mounting assembly having a housing, a magnet, a clip member, and an adhesive sheet, the housing having the magnet disposed therein, the clip member having first and second walls, the first wall having a first surface and a second surface disposed opposite to the first surface, the second wall having a biasing portion extending toward the first surface of the first wall, the second wall being coupled to the housing such that a gap is formed between the biasing portion and the first surface of the first wall, the adhesive sheet being disposed on the second surface of the first wall;

disposing a portion of the ribbon in the gap such that the biasing portion urges the ribbon against the first surface of the first wall to hold the portion of the ribbon within the gap; and attaching the medal to the adhesive sheet.

16. A method of mounting a medal on a mounting assembly, comprising:

providing the medal with a ribbon attached to the medal;

disposing a sheath member around a portion of the ribbon;

providing the mounting assembly having a housing, a magnet, a clip member, and an adhesive sheet, the housing having the magnet disposed therein, the clip member having first and second walls, the first wall having a first surface and a second surface disposed opposite to the first surface, the second wall having a biasing portion extending toward the first surface of the first wall, the second wall being coupled to the housing such that a gap is formed between the biasing portion and the first surface of the first wall, the adhesive sheet being disposed on the second surface of the first wall;

disposing the sheath member in the gap such that the biasing portion urges the sheath member against the first surface of the first wall to hold the sheath member and the portion of the ribbon within the gap; and attaching the medal to the adhesive sheet.

* * * * *